United States Patent [19]

Northrop

[11] Patent Number: 4,734,616

[45] Date of Patent: Mar. 29, 1988

[54] FLUORESENT LAMP WITH DOUBLE CATHODE AND PROBE

[75] Inventor: Donald P. Northrop, Glen Rock, N.J.

[73] Assignee: Duro-Test Corporation, North Bergen, N.J.

[21] Appl. No.: 915,911

[22] Filed: Oct. 1, 1986

Related U.S. Application Data

[63] Continuation of Ser. No. 599,456, Apr. 12, 1984, abandoned.

[51] Int. Cl.[4] ..... H01J 61/42; H01J 61/067

[52] U.S. Cl. ..... 313/492; 315/98

[58] Field of Search ..... 313/491, 492, 574; 315/98, 99

[56] References Cited

U.S. PATENT DOCUMENTS 3,504,218 3/1970 Emidy et al. ..... 313/492 X 3,898,503 8/1975 Shurgan ..... 313/492 X

*Primary Examiner*—Palmer C. DeMeo

*Attorney, Agent, or Firm*—Darby & Darby

[57] ABSTRACT

A dual cathode structure for a fluorescent lamp comprises a pair of electron emissive cathodes which are connected with a common junction and mounted to have an included angle therebetween. The first of the pair of cathodes has first and second leads coupled to an external source of electrical current and the second cathode structure has a first terminal coupled to the first cathode at a common junction and an anode flag connected to its second terminal to collect electrons when the filaments are operating in the anode half cycle. The collected electrons pass through the second cathode. The availability of the second cathode prolongs lamp life by permitting shifting of the hot spot.

13 Claims, 3 Drawing Figures

FLUORESENT LAMP WITH DOUBLE CATHODE AND PROBE

This is a continuation of application Ser. No. 599,456, filed Apr. 12, 1984, now abandoned.

BACKGROUND OF THE INVENTION

1. Field of the Invention

The invention pertains to fluorescent lamps and more particularly to fluorescent lamps having an improved dual cathode structure.

2. Description of the Prior Art

Hot cathode type fluorescent lamps ordinarily utilize a cathode/anode structure which includes a coiled tungsten wire having an emissive coating, such as barium oxide, that produces electrons when heated above 800° C. The emitted electrons will bombard an ionizable medium, such as mercury, together with a fill gas inside the fluorescent lamp resulting as the ultimate step in a series of electronic interactions in the emission of ultraviolet light. A phosphor on the wall of the lamp generates visible radiation in response to the impinging ultraviolet energy.

A prime cause of failure of fluorsecent lamps is the gradual deterioration of the emissive coating on the cathode. The emissive coating, when heated evaporates off the cathode until the lamp can neither be started nor properly operated.

U.S. Pat. No. 3,369,193 describes an electrode structure for use in instant start fluorescent lamps utilizing filamentary type cathodes having only one end of the filament connected via a base contact to the power supply, and a probe or flag structure coupled to the opposite end of the filamentary cathode. The flag structure will extend into the cathode fall space so that anode current on the anode half cycle flows through the cathode.

In U.S. Pat. No. 3,898,503 assigned to the assignee of the present invention, a dual cathode structure is described utilizing a pair of electrodes at at least one end of a fluorescent lamp. The electrodes have one end connected to each other and a common junction with an included angle between the two electrodes of approximately 45 degrees. The other (outer) ends of the electrode pairs are connected to a lamp ballast. An anode flag, or probe is connected to the junction of the electrode of the cathode pair. This junction is at the apex of the included angle between the two cathodes. The anode flag or probe extends into the arc stream, that is the stream of electrons flowing between the anodes/cathodes at opposite ends of the lamp. Any anode current collected by the probe or flag passes through one or the other of the cathode pair before leaving the lamp. The cathodes are thus heated by the exiting current which tends to equalize the heat of the cathode during lamp operation which equalization in turn diffuses the "hot spot" of the cathode. In the aforementioned U.S. Pat. No. 3,898,503 it was found that the heat equalization increased the operating efficiency of the lamp as well as extending the life of the filament cathode pair.

It will be noted however, that in the above mentioned U.S Pat. No. 3,898,503 the nominal cathode voltage is applied across both the first and second cathodes. Therefore each of the cathodes must be designed to accept half the voltage. Therefore standard cathodes available and used in the industry could not be used.

The effect of the above dual cathode structure is essentially one of connecting a probe or flag in the middle of a standard cathode. Due to physical limitations, however, the cathode will be stretched out. Since ballast circuits can only supply a limited amount of current, the amount of heat produced per volume of the cathode will be decreased since the same heat will be dissipated in a larger area. Since the filament coil now runs cooler, electron emissions decrease If the wire of the coil is made smaller to produce a higher temperature for a given voltage, less emission coating can be used and consequently there will be a decrease in cathode life.

It is also known in the art to utilize a dual cathode structure without a flag comprised of first and second cathode elements coupled at a junction and forming a V having similar characteristics to that described in U.S. Pat. No. 3,898,503, except that one of the elements of the cathode pair cathode elements is shorted out and the ballast supply is coupled across the other element of the cathode pair. In such a system the shorted out cathode can only act as a cold start cathode and is not operational during the initial starting operation of the lamp. Such a cathode works as follows. As the emissive material evaporates from the running or operating cathode (i.e. the ballast coupled cathode) a hot spot formed thereon will move during the life time of the cathode filament along the length of the filament. If this hot spot is near the junction of the two cathodes the shorted cathode will be heated causing the hot spot to shift to the shorted cathode and therefore prolong lamp life.

It will be noted that in this structure, where the shorted cathode is not heated by external currents, only current captured by the middle of the cathode provides for its heating. Current captured at or near the ends of the cathode will flow directly into the power supply. If the connections to the cathode are, however, reversed and the hot spot begins at the junction of the two cathodes when the emissive material of the first cathode has been utilized, the hot spot will have moved to an end furthest away from the shorted cathode. The shorted cathode, therefore, will not be heated and therefore will not emit electrons. There is thus no enhancement of lamp life. Although the manufacture of lamps is generally standardized the manufacture of the ballast system is not and thus ballast connections may be improper. Consequently such long life fluorescent tubes only have a 25% chance that the lamp will be correctly connected and lamp life lengthened.

Generally the hot spot will begin at the end of the cathode connected to the higher potential. It will be noted that since there is a voltage drop across cathode filaments in addition to the cathode voltage, one end of the cathode filament will always have a higher potential than the other end. Generally this is where the hot spot begins.

Furthermore, in the a cold start/shorted cathode dual cathode structure refered to above the ordinarily cold or shorted cathode may become fouled by impurities boiled off from the operating cathode. These impurities often show up in lamps as a discoloration on the sidewalls of the lamp. These impurities when boiled off onto the cold cathode may cause the cold start cathode to be difficult to operate.

SUMMARY OF THE INVENTION

The present invention comprises a structure having two cathodes of a standard type joined at an apex. The first cathode will be coupled to a voltage or current source and have a nominal voltage across it to supply heating currents thereto. The second cathode will be coupled at one end to the first cathode and thereafter to the power supply. The other end of the second cathode will be coupled to a probe or flag which extends into the anode/cathode fall. In operation, a portion of the current in the arc of the lamp will be collected by the probe or flag, flow down through the second cathode and heat it.

It is thus an object of the present invention to provide a simple dual cathode structure having an enhanced life compared to standard cathode structures.

It is further an object to provide a dual cathode structure in which the second cathode is always heated and does not become fouled with pollutants.

It is a further object to provide an energy saving cathode structure.

It is still another object of the invention to provide a system that may be easily assembled on existing equipment without requiring special holes for the leads or special prodecures to assure that the proper leads are coupled to the pins of the socket.

It is still another object of the invention to provide a dual cathode structure in which the second cathode is always heated and therefore prolongs cathode life regardless of the couplings of the ballast circuit.

These and other advantages and objects of the present invention will become more obvious upon reference to the description and annexed drawings.

DESCRIPTION OF THE PREFERRED EMBODIMENT

Figure 1:
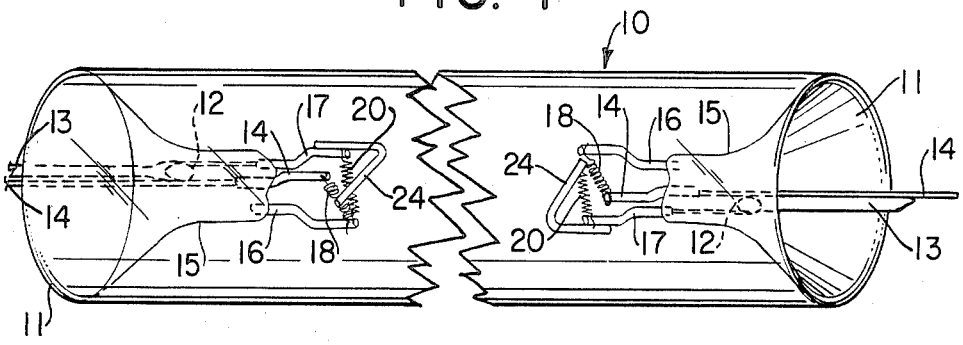
FIG. 1 is a view of a lamp using the improved cathode structure of the present invention.
Figure 2:
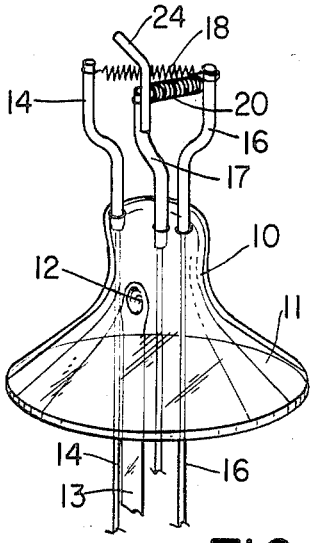
FIG. 2 is a perspective view of the improved cathode structure.

Referring to FIGS. 1 and 2 the dual cathode structure of the subject invention is shown in a fluorescent lamp 10 of a conventional type having conventional phosphors, fill gas, ionizable material, etc. Since the lamp components other than the cathode are conventional they will not be described in detail The cathode structure of the invention as shown is mounted at each end of the lamp and includes the usual stem press 15, with flared stem 11 having a hole 12 which communicates with an exhaust tube 13 from which the fluorescent lamp 10 is exhausted. The stem structure material is conventional and the structure is mounted at the end of the envelope by a suitable conventional technique, such as to glass-to-glass sealing.

Mounted on the lead wires 14, 16 and 17 are a pair of filament cathodes 18 and 20 which are also of the conventional construction, i.e. such as of the coiled-coil type. These cathodes are similar, or identical in construction and coated with an electron emissive material typically an alkaline earth oxide, for example, barium oxide. The cathodes 18 and 20 which are used in the dual structure may be identical to those utilized in conventional single cathode lamps and preferably utilize a multi-turn overwound design with parameters commonly employed by the industry for preheat, rapid start fluorescent lamps. The two cathodes need not be identical, however, since the coil connected to the flag may not carry the same current as the coil heated by the ballast circuitry.

Filament 18 is held between a pair of electrically conductive support members 14 and 16 mounted in the press 15 while filament 20 is mounted between support 16 and another support member 17 also mounted in the press 15. As shown in FIG. 2 the supporting lead wires 14 and 16 are brought out external to the lamp to conventional terminals (not shown) through respective lead wires at the bottom of the flare 11. The filament supports can be, and usually are, extensions of the lead wires. Support member 17 terminates on the outside of the lamp, but is insulated from the other support members 14 and 16 and the corresponding lead wires. Consequently, and as described below, current gathered by probe 24 must flow through cathode 20. Support lead 17, like support leads 14 and 16 is also electrically conductive. As is conventional the flare 11 is sealed at the end of the tubular envelope and the envelope is provided with a cap (not shown) having terminals connected to leads 14 and 16.

In a preferred embodiment of the invention the two cathodes 18 and 20 are mounted with an included angle of approximately 40 to 45 degrees therebetween. This angle is not critical; angles up to about 90 degrees, and even somewhat greater may be satisfactory. Furthermore, the cathodes 18 and 20 need not be in the same plane perpendicular to the axis of the lamp.

An anode probe 24 is mounted on and is electrically connected to support 17 of the cathode pair. Probe 24 is of conventional construction of an electrically conductive material such as nickel clad steel, or nickel wire. The probe 24 has only this one electrical connection. Probe 24 may, as shown in FIG. 2, be of L-shape formed wire having first and second legs at right angles to one another. Probe 24 is mounted so that the first leg is electrically coupled to support 17, and the second leg extends over the region of the generally triangular area having corners defined by supports 14, 16 and 17. Other probe shapes known in the art and adapted to gather electrons from an arc stream may also be used.

Alternatively an anode flag, also known in the prior art, may be used in place of probe 24. The anode flag is generally formed from electrically conductive sheet material, instead of wire, and is also electrically coupled to support 17. It may also be formed in an L shape, extending into the arc stream, over the aforementioned triangular region. Other flag shapes known in the art may also be used.

In accordance with the subject invention the probes 24 connected to the lead 17 of the dual cathode structure at each end of the lamp alternately functions as an anode to draw the electrons emitted by the cathode at the other end of the lamp 40. It should be understood that since the lamp is operated on alternating current, one cathode structure is receiving negative going voltage and emitting electrons while the other cathode structure is receiving voltage whose polarity is more positive than the first. The electrons emitted from the cathodes of negative polarity are drawn into the electrode structure of more positive polarity at the opposite end of the lamp and are collected in part by the probe 24. The electrons collected by the respective probes 24 can travel only one path, through cathode 20 to the external supply coupled to lead 16. Upon reversal of the polarity of the current electron flow will reverse and electrons will be emitted by the cathode at the previously collecting end of the lamp. Similarly, the probe or flag at the previously electron emitting end of the lamp will now collect electrons.

In operation lamp 10 will be started by applying a current to starting cathode 18. After the lamp has started probe 24 will capture current which will flow down the probe and through the operating cathode 20. The current must flow through operating cathode 20 since lead 17 is electrically isolated. Depending upon the connection of the lamp to the ballast circuitry, the captured current will then flow out to lead 16 or through cathode 18 and out through lead 14. Cathode 20 will be heated, however, regardless of the ballast circuitry connection.

Figure 3:
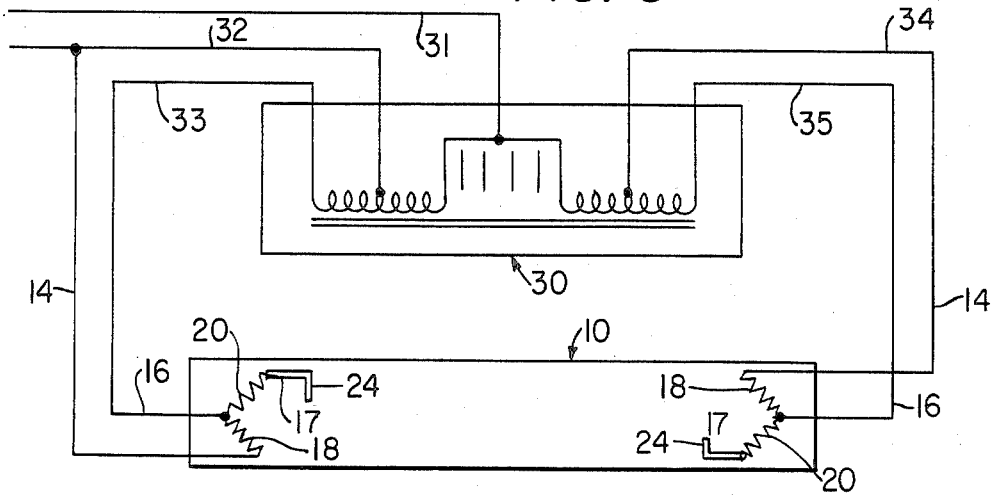
FIG. 3 is a schematic diagram of a ballast circuit with a lamp using the cathode structure of the present invention.

Referring to FIG. 3 the novel dual cathode is shown operating in a conventional fluorescent lamp starting circuit. One dual cathode structure is provided at each end of an otherwise conventional fluorescent lamp 10. In FIG. 3 the ballast autotransformer is designated 30 and has two input leads 31 and 32 connected to a source of alternating current line voltage. Lead 32, the common line, and lead 33 coming out of the ballast autotransformer 30 at one end of the primary winding form a portion of the primary voltage winding which is tapped off to supply low voltage filament current, across the filament 18 through leads 14 and 16 at a first end of the lamp. Lead 17 is left unconnected. Two lines 34 and 35 top off a portion of a secondary winding of the autotransformer's supply filament voltage across the cathode 18 at the second end of the lamp. Again lead 17 is left unconnected. The operating voltage is applied to the two cathodes at the opposite ends of the lamp across the primary and secondary of the ballast transformer. Probes or flags 24 are shown connected to the unconnected end of cathodes 20.

In accordance with the subject invention, the probe 24 connected to lead 17 and the cathode structure 20 at each end of the lamp alternately functions to emit electrons and as an anode to "draw" electrons emitted by the cathode at the other end of the lamp. The electrons emitted from the cathode of more negative polarity are drawn to the cathodes of more positive polarity at the opposite end of the lamp and are collected by the probe 24. The electrons collected by the probe 24 will then flow through cathode 20 and depending upon the connection of the lamp to the external power supply flow through lead 16 or lead 14 to the external power supply.

Referring again to FIG. 3 leads 32 and 33 coupled to auto transformer 30 have a potential difference of between 3.5 to 5 volts between them in the United States. In other countries, the potential difference may be higher. This potential difference is adequate to heat cathode 18 to the point of electron emission Furthermore, a higher voltage potential difference is impressed upon leads 33 and 32 with respect to lead 31 which potential difference is sufficient to maintain the electron arc stream across the lamp. As may be seen from FIG. 3 the voltage on lead 33 will be higher than the voltage on lead 32.

The r.m.s. voltage at the support 16 end of cathode 18 is always higher than the voltage at the support 14 end of the same cathode. Consequently, the electron arc stream tends to concentrate at the end of cathode 18 near support 16 and the "hot spot" begins there. During normal operation the hot spot is produced on a cathode by the ionic bombardment. The size of the spot is usually a few turns of the filament coil and the temperature reached is considerably above 900° C. As the emissive material is boiled off cathode 18, the hot spot moves to regions of the filament having a lower work function where the emissive coating has not been all or partially bombarded away and over the life of the lamp progresses towards support 14.

Since cathode 18 is resistive, as the hot spot moves along its length towards support 14 it will be located at a points having a lower potential then that appearing at support 16. Since, there is a smaller voltage drop between the hot spot and support 16 there is consequently a larger voltage drop across the lamp. As the voltage drop across the lamp rises with lamp age higher arc current will become available through probe 24 and consequently cathode 20 will heat to a higher temperature. As cathode 20 heats to a higher temperature it becomes able to take over the role of electron emission and thereby prolong the life of the fluorescent lamp cathodes.

Cathode 20 cannot be used ordinarily to start the lamp during its operation. When the hot spot is shifted to it, however, the emissive material coating filament 20 will boil off the filament some of which deposits on filament 18. This emissive material will be sufficient to start the lamp under normal starting conditions and then permit the hot spot to switch back to cathode 20.

It is also possible to cause the hot spot to switch from cathode 18 to cathode 20 in the beginning of the lamp life by the choice of the probe 24 size and cathode 20 mass. Selecting the size and length of the probe will direct a specific current to cathode 20 and enable control of probe current. Selection of the proper cathode mass controls the heat generated. When the second cathode operates and depletes through normal means, the starting cathode will continue to operate since it has not depleted its emissive coating. Use of the second cathode in this mode will also extend life over normal lamp.

In the previously described dual cathode structure without probe or flag having two series connected cathodes, one of which is shorted, after the lamp has been sealed but before the base has been applied it is necessary to couple the lead at the junction point of the series connected cathodes to one of the two remaining leads, of the cathodes to short. Upon basing only the two leads are to be connected to the two fluorescent lamp pins. To permit proper operation of the lamp the two correct leads must be selected for attachment to the base pins. In the present invention lead 17 is made short or clipped off prior to basing therefore leaving only two leads to be connected for the basing step. Orientation is thus easier and the problem of basing reverts to the normal two wire threading process eliminating the need for the non-standard bases and consequently mistakes in threading wiring. It also adds simplicity to automatic basing devices.

A further improvement resulting from the present invention is realized since standard bi-pin bases have pins large enough to accommadate two holes for a double cathode lamp. Since only one wire per pin is used, the pin tip hole can be made smaller leading to better cutting and welding and therefore improve quality of the pin tip.

Also, as stated in the aforementioned U.S. Pat. No. 3,898,503, lamps using a probe show a decrease in power consumed compared to lamps without anode probes or flags. This decrease is obtained principally by a decrease in voltage drop across the lamp, since the probe intercepts the electron arc at a point of lower potential than the filamentary cathodes ordinarily would. Lamp efficiency may therefore be improved and power consumption decreased.

What is claimed is:

1. A fluorescent lamp of the type having a sealed envelope with a phosphor coating on an internal wall thereof and having an electrode at each end adapted to receive current from an external current source and an ionizable medium for supporting an electron arc stream therein between said electrode, wherein at least one of said electrodes comprises:

first cathode means having first and second ends adapted to be electrically connected to two active leads of said external current source for emitting electrons resonsive to an electric current received from said external source;

second cathode means having first and second ends for emitting electrons responsive to an electric current, said second cathode means first end being electrically connected to said first cathode means first end and thereby adapting it to be connected to one active lead of said external current source and its second end left unconnected; and electron collecting means electrically connected to said second cathode means second end and extending outwardly from said second cathode means toward the electrode at the other end of the envelope and into the electron arc stream for capturing electrons from said arc stream and supplying the electric current resulting therefrom to said second cathode means, said electron collecting means collecting electrons in an amount of sufficient current to induce thermionic heating of said second cathode means to cause it to emit electrons such that at least a part of the production of said electron arc stream transfers from said first to said second cathode means.

2. The fluorescent lamp according to claim 1 wherein said envelope is elongated and has a longitudinal axis parallel to the direction of elongation and said electrodes are mounted opposing each other along said axis at the respective end of said envelope.

3. The fluorescent lamp according to claim 2 wherein said first and second cathode means of said at least one of said elecrodes, comprises first and second filaments, respectively.

4. The fluorescent lamp according to claim 3 wherein each of said first and second filament is substantially linear, and each is mounted substantially transverse to said longitudinal axis.

5. The fluorescent lamp according to claim 4 wherein said first and second cathode means are mounted in said envelope and have an included angle of less than 90° therebetween.

6. The fluorescent according to claim 5 wherein each of first and second cathode means has an electron emissive coating thereon.

7. The fluorescent lamp according to claim 6 wherein said coating is comprised of an alkaline earth oxide.

8. The fluorescent lamp according to claim 5 wherein said electron collecting means comprises a flag extending into said arc stream and having a portion substantially transverse to said longitudinal axis of said envelope.

9. The fluorescent lamp according to claim 8 wherein said flag is of an electrically conductive metal.

10. The fluorescent lamp according to claim 5 wherein said electron collecting means comprises a probe extending into said arc stream and having a portion substantially transverse to said longitudinal axis of said envelope.

11. The fluorescent lamp according to claim 10 wherein said probe is an electrically conductive wire.

12. A fluorescent lamp as in claim 1 wherein said at least one of said electrodes having said first and second cathode means is located at each end of said envelope.

13. A fluorescent lamp as in claim 1 wherein said at least one of said electrodes having said first and second cathode means is located at each of said envelope.

* * * * *